US005898946A

United States Patent [19]

Keating et al.

[11] Patent Number: 5,898,946

[45] Date of Patent: May 4, 1999

[54] GOLF HAT AND BALL MARKER ASSEMBLY

[76] Inventors: Meryck Valintine Keating; Linda Keating, both of 57 Beech Ter., Wayne, N.J. 07470

[21] Appl. No.: 09/003,176

[22] Filed: Jan. 5, 1998

[51] Int. Cl.[6] ..... A42B 1/24

[52] U.S. Cl. ..... 2/209.13; 224/918; 473/406

[58] Field of Search ..... 2/209.13, 422, 2/425; 224/918; 473/406

[56] References Cited

U.S. PATENT DOCUMENTS

| | | | |
|---|---|---|---|
| 2,049,438 | 8/1936 | Gollwitzer . | |
| 3,139,690 | 7/1964 | Hait . | |
| 3,895,797 | 7/1975 | Moore | 473/406 |
| 3,938,805 | 2/1976 | Sakuma . | |
| 4,081,114 | 3/1978 | Inoue . | |
| 4,130,950 | 12/1978 | Bazzle et al. | 473/406 |
| 4,315,624 | 2/1982 | Buckman . | |
| 4,530,500 | 7/1985 | Kaymen . | |
| 4,896,375 | 1/1990 | Colucci . | |
| 5,031,812 | 7/1991 | Gustine . | |
| 5,135,220 | 8/1992 | Baldoni . | |
| 5,143,371 | 9/1992 | Strahan . | |
| 5,282,616 | 2/1994 | Stacavich-Notaro . | |
| 5,295,683 | 3/1994 | Tate . | |
| 5,364,094 | 11/1994 | Mustion . | |
| 5,417,426 | 5/1995 | Bayer . | |
| 5,419,551 | 5/1995 | Hoyt et al. . | |
| 5,556,135 | 9/1996 | Duncan . | |
| 5,569,103 | 10/1996 | Sihn . | |

*Primary Examiner*—Diana Biefeld
*Attorney, Agent, or Firm*—Brown Raysman Millstein Felder & Steiner

[57] ABSTRACT

A golf hat and golf ball marker assembly containing a hat, a metal strip, and a disc-shaped, metallic golf ball marker. The metal strip is affixed to the side of the hat such as by rivets. Positioned on one side of the strip is a depressed well having a magnetized bottom. The diameter of the well is slightly larger than the diameter of the marker so that the marker fits snugly in place in the web with a very little lateral movement. The depth of the well is slightly less than the thickness of the marker so that the marker extends slightly out of the well for each removal. The marker is held in the well when not in use by virtue of magnetic attraction.

8 Claims, 3 Drawing Sheets

GOLF HAT AND BALL MARKER ASSEMBLY

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

It is well known that when a golf ball is hit onto the putting green, a marker is used to temporarily mark the position of the ball so that the ball may be removed to allow another golf ball to be played. When the first golf ball is ready to be putted, the marker is picked up and replaced with the ball. This action occurs frequently throughout a round of golf. The marker must therefore be held in a convenient location which is easily accessible to the golfer and from which the marker will not be lost.

Several articles have been suggested for holding markers. U.S. Pat. No. 4,315,624 disclosed a ground repair tool chain retains a ball marker, and U.S. Pat. Nos. 3,895,797, 4,930, 500, and 5,364,094 disclose articles for holding ball markers which can be releasable attached to or held by the golfer's clothing. Because these items are small and not securely attached to anything, they may become misplaced when not is use and require golfers to specifically remember to take them when going to play golf. Also, these articles may need to be worn in places which many golfer's find uncomfortable, such as on a belt or shirt.

U.S. Pat. No. 4,130,950 discloses a marker held to a golf shoe by a permanent magnet. The marker is positioned in a place which for which for many golfers is difficult to reach and from which it may become lost without the golfer realizing it.

U.S. Pat. No. 5,135,220 discloses a marker held to a flexible web worn about a golfer's wrist. This is another article of the type described above which the golfer must specifically remember to bring and which may become lost. Furthermore, the flexible web may be uncomfortable to some golfers and may even interfere with their play.

Thus, there remains a need for an article for holding a golf ball marker which is easily accessible to the golfer and which minimizes the inconvenience to the golfer and the risk of being lost or misplaced. The present invention provides such an article.

BRIEF SUMMARY OF THE INVENTION

It is an object of the present invention to solve the problems described above associated with the existing articles for holding golf ball markers.

It is another object of the present invention to provide a convenient and easily accessible location for holding a golf ball marker while playing golf.

It is another object of the present invention to provide an article for holding a golf ball marker which will not be easily misplaced or lost.

These and other objects are achieved by a golf hat and golf ball marker assembly comprising a hat, which may be a visor as conventionally worn by women golfers, a metal strip, and a disc-shaped, metallic golf ball marker. The metal strip is affixed to the hat such as by rivets. Positioned on one side of the strip is a depressed well having a magnetized bottom. The diameter of the well is slightly larger than the diameter of the marker so that the marker fits snugly in place in the web with a very little lateral movement. The depth of the well is slightly less than the thickness of the marker so that the marker extends slightly out of the well for each removal. The marker is held in the well by virtue of magnetic attraction.

BRIEF DESCRIPTION OF THE DRAWINGS

The invention is illustrated in the figures of the accompanying drawings which are meant to be exemplary and not limiting, in which like references refer to like or corresponding parts, and in which.

DETAILED DESCRIPTION OF THE PREFERRED EMBODIMENTS

Figure 1:
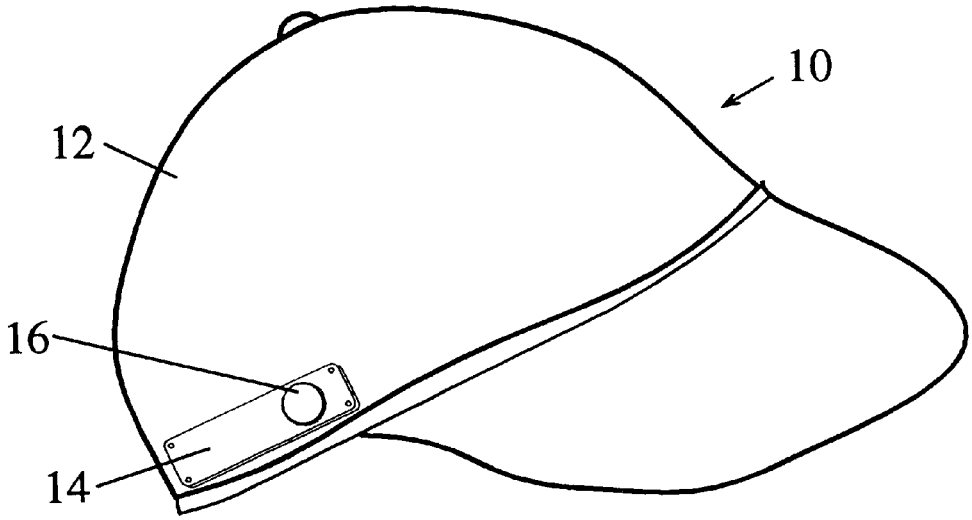
FIG. 1 is a perspective view of a golf hat and ball marker assembly of one preferred embodiment of the invention.

The invention is described with reference to the drawings in FIGS. 1–9. As shown in FIG. 1, a golf hat and marker assembly 10 of one preferred embodiment of the present invention consists of a golf hat 12, a metal strip 14 affixed to a side of the golf hat 12, and a marker 16 held in the strip 14 as further described below. The hat 12 is a conventional hat worn while golfing to shield a golfer from the sun, and can be the baseball-style cap shown in FIG. 1 or any other style of hat. The hat may be a visor, such as that shown in FIG. 10, typically worn by woman golfers. In accordance with the invention, the golfer wearing the hat 12 has easy access to the marker 16 held in the strip 14, can remove the marker 16 when needed to mark the position of a golf ball and can return the marker 16 to the strip 14 when done, all without the need to remove the hat.

Figure 2:
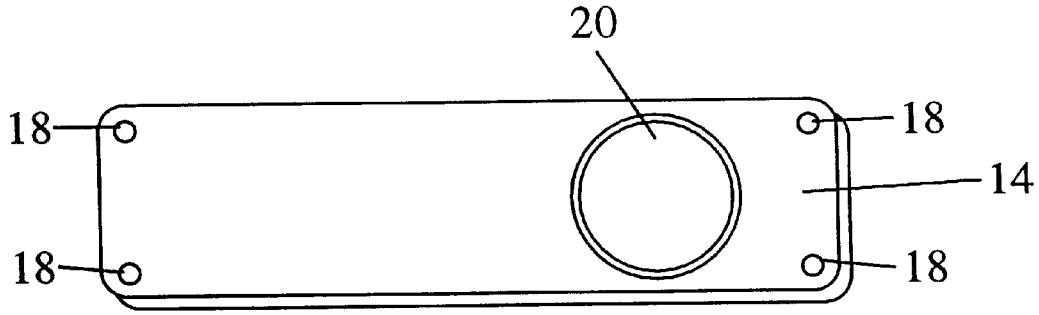
FIG. 2 is a top view of a strip used in accordance with one preferred embodiment of the invention.
Figure 3:
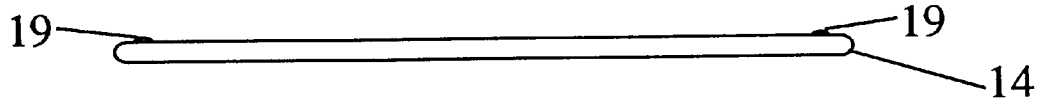
FIG. 3 is a side view of the strip shown in FIG. 2.

The metal strip 14 is shown in more detail in FIGS. 2 and 3. The strip 14 is thin and rectangularly shaped, having a length of about 7 cm, a width of about 2.5 cm, and a thickness of about 3 mm. The strip 14 may be made of a rigid metal or alloy such as steel, or may be flexible so as to bend with the contours of the hat. The corners of the strip 16 have holes 18 through which are inserted rivets 19 (FIG. 3) for attachment of the strip 14 to the hat 12. The strip 14 may be securely attached to the hat 12 by other means, such as by welding, soldering, or by attaching a fabric rim around the periphery of the strip 14 which is sewn to the hat 12.

Figure 4:
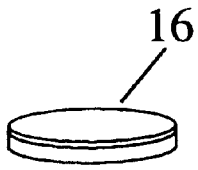
FIG. 4 is a side view of a marker used in accordance with one preferred embodiment of the invention.
Figure 5:
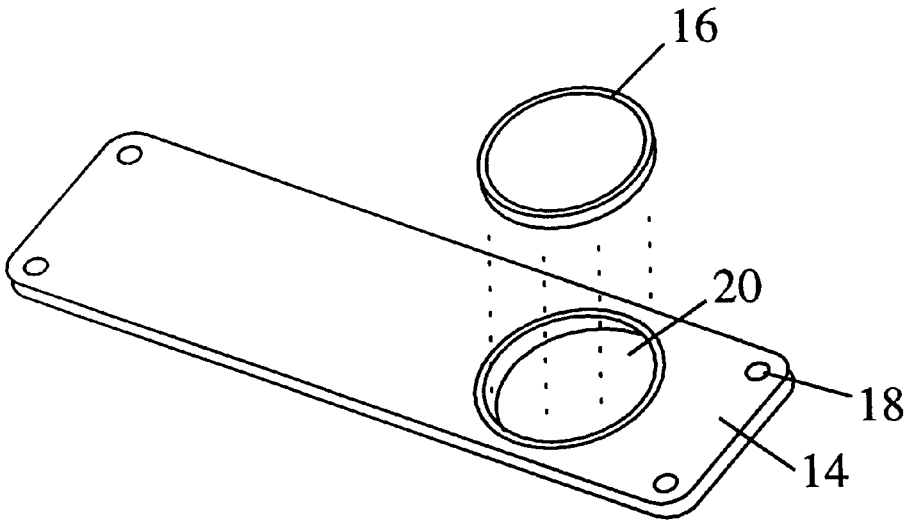
FIG. 5 is a perspective, exploded view of the strip shown in FIG. 2 and marker shown in FIG. 4.

On one side of strip is a depressed well 20 of circular cross section. The diameter of the well 20 is about 2 cm, and the depth is about 1.2 mm. The marker 16, shown in FIG. 4, is disc-shaped, having a diameter of about 1.8 cm and a thickness of about 3 mm. The well's diameter is thus slightly larger than the diameter of the marker 16, so that the marker 16 fits snugly within the periphery of the well 20 and does not move laterally to any substantial degree as the golfer moves around. Fig .5 illustrates in an exploded view the positioning of the marker 16 within the well 20. Those of skill in the art will recognize that the dimensions of the strip 14, marker 16 and well 20 may vary as design parameters.

To attract the marker 16 into the well 20 and hold it there securely, the bottom of the well 20 is magnetized and the marker 16 is composed of a metal attracted to magnets. The strength of the magnetization of the well 20 is designed as known to those of skill in the art to attract the marker 16 into the well 20 when the marker 16 is near the well 20 (such as when the marker 16 is placed on the strip 14) and to hold the marker 16 in the well 20 with sufficient force to prevent it from falling out due to the golfer's motion, but not too strong to prevent the golfer from removing the marker easily when needed. The remainder of the strip 14 is preferably not magnetized so that the marker 16 is only attracted to the well 20. This facilitates the golfer's insertion of the marker 16 into the well 20 without the need to remove the hat 12 to locate the well 20.

Figure 6:
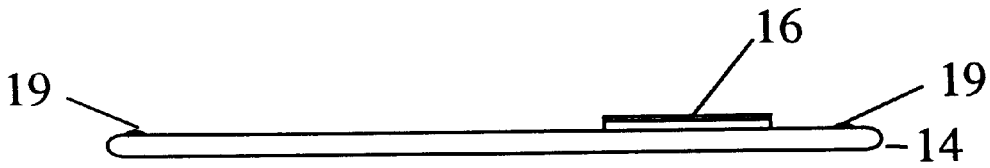
FIG. 6 is a side view of the strip and marker of FIG. 5 in an assembled condition.

Due to the relative depth of the well 20 as compared to the thickness of the marker 16, the marker 16 also projects slightly out of the well 20, as shown in FIG. 6. This facilitates the location of the marker 16 along the strip 14 by the golfer without having to remove the hat 12 to look at the strip 14, and further facilitates the removal of the marker 16 from the well 20 by pushing on the marker 16 with a finger and grabbing the marker 16 as it slides out of the well 20. The top of the marker 16 may be planar as shown in FIG. 6 or may be concave.

Figure 7:
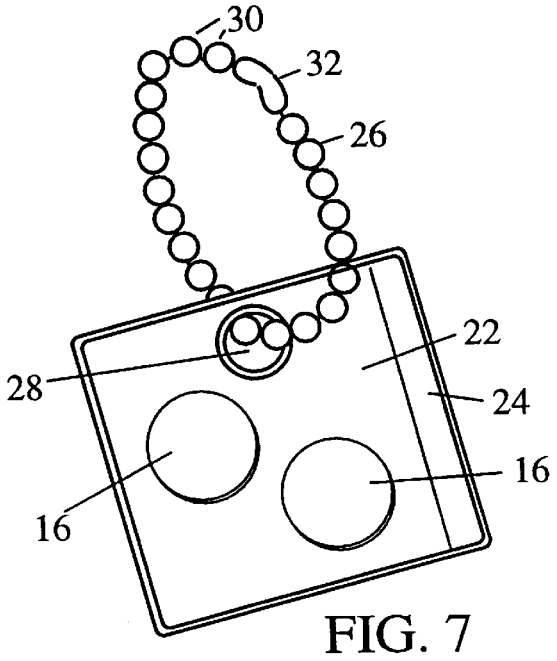
FIG. 7 is a perspective view of a packet holding multiple markers in accordance with one preferred embodiment of the invention.

As shown in FIGS. 7–10, a plurality of markers 16 may be releasably attached to the hat 12 for sale of the hat and marker assembly 10 with multiple markers or for carrying with the hat 12 during play. Referring to FIG. 7, two or more markers 16 are placed in a transparent, plastic packet 22 which may be opened and closed by virtue of a conventional closure mechanism 24 such as a zip lock. A chain 26 is inserted through a hole 28 in the packet 22 to releasably attach the packet 22 of markers 16 to the hat 12. The chain 26 is the conventional type used, for example, with key chains, having a series of connected balls 30, the last of which is insertable in an elongated link 32 having an opening on one side.

Figure 9:
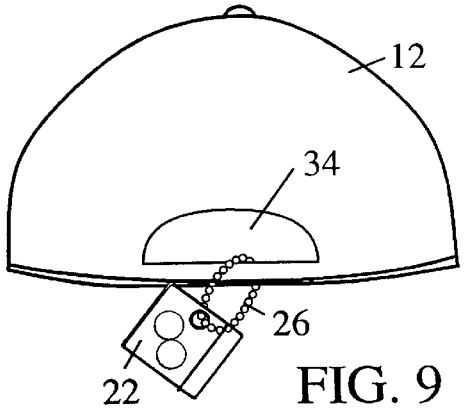
FIG. 9 is a rear view of the hat and marker assembly of FIG. 8.
Figure 8:
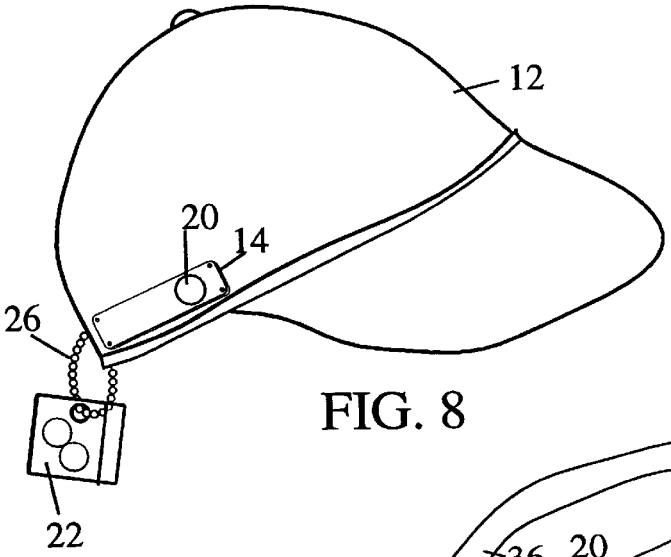
FIG. 8 is a perspective view of the hat and marker assembly of FIG. I with the packet of Fig.7 attached thereto.
Figure 10:
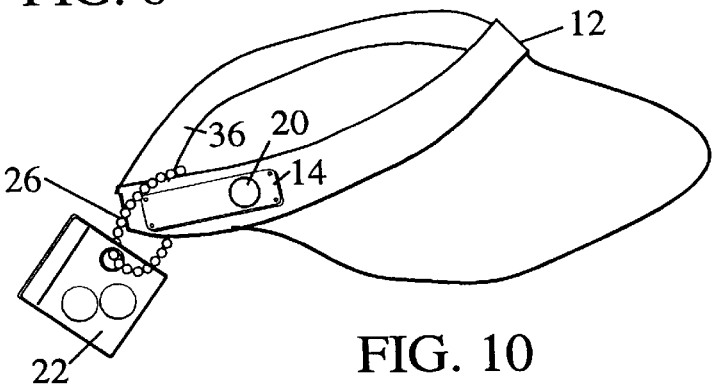
FIG. 10 is a perspective view of a visor, marker and packet assembly in accordance with another preferred embodiment of the invention.

The chain 26 may be connected to the hat 12 at any convenient location. For example, in the baseball-style cap 12 shown in FIGS. 8 and 9, the chain 26 is inserted through the gap 34 in the back of the hat 12. In the case of a visor 12', as shown in FIG. 9, the chain 26 is wrapped around the rim 36 of the visor 12'. Multiple markers 16 may thus be sold with the hat 12 and even carried around with the hat 12 while golfing.

While the invention has been described and illustrated in connection with preferred embodiments, many variations and modifications as will be evident to those skilled in this art may be made without departing from the spirit and scope of the invention, and the invention is thus not to be limited to the precise details of methodology or construction set forth above as such variations and modification are intended to be included within the scope of the invention.

What is claimed is:

1. A golf hat and golf ball marker assembly comprising;

a golf hat;

a metallic strip affixed to a side of the hat;

a well in part of the strip, the well having a circular cross section of a first diameter and having a depth, the bottom of the well being magnetized; and a metallic golf ball marker having a disc shape with a second diameter smaller than the first diameter, the marker having a thickness slightly larger than the depth of the well;

the marker being insertable within the well and held in place by magnetic attraction and being removable for placement on the ground to mark a golf ball's position.

2. The assembly of claim 1 wherein the strip is rectangular in shape.

3. The assembly of claim 1 where the strip is attached to the hat by rivets.

4. The assembly of claim 1 comprising a plurality of golf ball markers held in a packet, the packet being releasably attachable to the hat.

5. The assembly of claim 4 wherein the packet is releasably attached to the hat by a chain.

6. The assembly of claim 1 wherein the golf hat is a visor.

7. The assembly of claim 1 wherein the part of the strip excluding the well is not magnetized.

8. The assembly of claim 1 wherein the strip is rigid.

* * * * *